US005577635A

United States Patent [19]

Block

[11] Patent Number: 5,577,635

[45] Date of Patent: Nov. 26, 1996

[54] PROTECTIVE SHEET DISPENSER

[75] Inventor: Alvin Block, 12776 Touchstone Pl., Palm Beach Gardens, Fla. 33418

[73] Assignees: Alvin Block; John Cimba, both of Palm Beach Gardens, Fla.; a part interest

[21] Appl. No.: 498,245

[22] Filed: Jun. 29, 1995

[51] Int. Cl.[6] ..... A47K 10/24

[52] U.S. Cl. ..... 221/45; 221/283

[58] Field of Search ..... 221/45, 47, 48, 221/33, 282, 283; 206/449, 494, 812, 824

[56] References Cited

U.S. PATENT DOCUMENTS 1,148,758 8/1915 Cohn ..... 221/45

4,877,154 10/1989 Matsui ..... 221/48

*Primary Examiner*—Kenneth Noland

*Attorney, Agent, or Firm*—Kirschstein et al.

[57] ABSTRACT

A protective dispenser for dispensing serially arranged sheet materials, includes a container bounding an open-ended internal chamber for receiving the materials. A partitioning wall spans the internal chamber and supports the materials. The partitioning wall has an opening for the successive passage of the materials therethrough. The partitioning wall is disposed at a distance from the open end of the chamber so that a skirt region of the container that surrounds the open end provides an environment that is sheltered from the elements for the materials to emerge into after passing through the opening. The skirt region may be provided with an aperture for the passage of the respective material therethrough from the sheltered environment to the outside of the container. A channel may be formed at the exterior of the container, leading from the aperture all the way to a free end of the skirt region. The dispenser may further include a sheath that surrounds at least a part of the container in an assembled condition of the dispenser. An eyelet bounding an orifice for the passage of a portion of a support therethrough may be provided at an end portion of the container that is remote from the skirt region for suspending the container from the support.

13 Claims, 1 Drawing Sheet

PROTECTIVE SHEET DISPENSER

BACKGROUND OF THE INVENTION

1. Field of the Invention

The present invention relates to containers in general, and more particularly to a container arrangement for dispensing sheet materials, especially towels.

2. Description of the Related Art

There are already known various constructions of containers, among them such that are designed for accommodating rolls, stacks, or other arrangements consisting of serially arranged sheet materials, especially dry or wet towels or tissues intended for use, for instance, by mothers of children of tender years to clean the faces or other parts of the bodies of such children. In this context, it is known that, due to the serially intertwined or nestled arrangement of the sheet materials, the respective previous or leading one of the sheet materials pulls with it the next succeeding one until a portion of the latter projects through an opening provided in the container for the removal of such sheet materials at which time the preceding or leading sheet material becomes dissociated from the succeeding sheet material and can be used for its intended cleaning purpose.

As advantageous as the containers of this kind may be for the purposes contemplated for them, they leave something to be desired as far as their use in other environments or for other purposes is concerned. More particularly, there are occasions when a person would like to avail himself or herself of a dry clean towel or tissue even though such a person is at a location exposed to the elements and especially to precipitation.

Under these circumstances, the heretofore proposed sheet material containers either do not provide any protection from the elements at all, or are completely sealed or closed, in which case it is quite cumbersome to gain access to them. Despite this complexity, however, it cannot always be assured that the sheet materials remaining in the container will not become wet as the sheet material to be used is being withdrawn through the opening, especially because the traditional containers of this kind are typically designed in such a manner that the aforementioned opening faces upwardly during such sheet material withdrawal.

OBJECTS OF THE INVENTION

Accordingly, it is a general object of the present invention to avoid the disadvantages of the prior art.

More particularly, it is an object of the present invention to provide a protective sheet material dispenser that does not possess the drawbacks of the known dispensers of this type.

Still another object of the present invention is to devise a dispenser of the type here under consideration which protects and shelters the sheet materials from environmental influences, not only while they are still a part of a roll or stack of such materials, but also when they are already partially withdrawn from such a roll or stack.

It is yet another object of the present invention to design the above dispenser in such a manner as to permit relatively easy access to the thus sheltered portion of the partially withdrawn sheet material.

A concomitant object of the present invention is so to construct the protective sheet material dispenser of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a protective dispenser for dispensing serially arranged sheet materials. According to the present invention, the dispenser includes a container bounding an open-ended internal chamber for receiving the sheet materials, and supporting means in the internal chamber for supporting the sheet materials. Such supporting means includes a partitioning wall spanning the internal chamber of the container and having a substantially centrally arranged opening therein for the successive passage of the sheet materials therethrough. The partitioning wall is disposed at a predetermined distance from an open end of the chamber.

A particular advantage of the arrangement as described so far is that a skirt region of the container that surrounds the open end provides an environment that is sheltered from the elements for the sheet materials to emerge into after passing through the opening. Hence, the thus emerging portions of such sheet materials are protected from the elements while in the thus sheltered environment.

Advantageously, the skirt region has at least one aperture therein for the passage of the respective material therethrough from the sheltered environment to the outside of the container. It is further advantageous in this context when the skirt region includes means for forming a channel at the exterior of the container leading from the aforementioned aperture all the way to a free end of the skirt region.

According to another aspect of the present invention, the dispenser further includes a sheath surrounding at least a part of the container in an assembled condition thereof. The sheath is advantageously generally sleeve-shaped, having two open end portions one for the passage therethrough of an end portion of the container that is remote from the skirt region. Under these circumstances, it is particularly advantageous when the remote end portion of the container and the one end portion of the sheath have compatible configurations diverging toward the skirt region and the other of the end portions, respectively.

According to another facet of the present invention, there is provided at least one closeable pocket on the exterior of the sheath. It is also advantageous when the container has means, preferably on its end portion that is remote from the skirt region, for suspending the container from a support. Such suspending means advantageously includes an eyelet bounding an orifice for the passage of a portion of the support therethrough.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
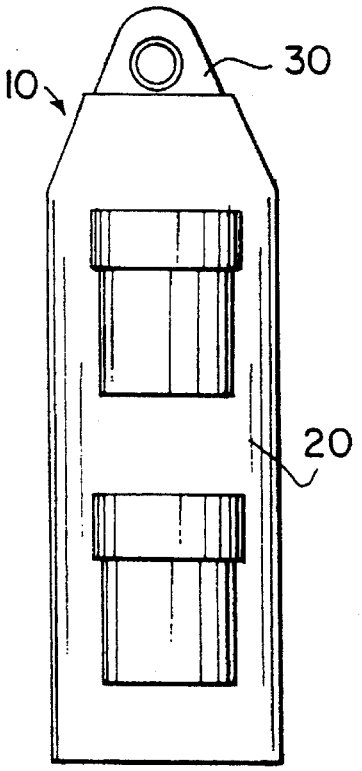
FIG. 1 is a front elevational view of a protective sheet material dispenser of the present invention in its fully assembled condition.

Referring now to the drawing in detail, and first to FIG. 1 thereof, it may be seen that the reference numeral 10 has been used therein to identify a protective sheet material dispenser of the present invention in its entirety. At this juncture, it is to be mentioned that the dispenser 10 is to be used for dispensing sheet materials, which term is contemplated to encompass not only what is commonly known as facial towels, but also other kinds of usually moisture-absorbing sheet-shaped items, such as towels or towelettes, be they of paper, as is usually the case, or of textile materials, such as terry cloth or the like. The dispenser 10 will ordinarily be used in the orientation illustrated in FIG. 1 of the drawing for which it has been designed and in which it exhibits all of its advantages. Thus, it is this initially mentioned ordinary or regular orientation or position that will be used as a basis for establishing a frame of reference for the various directions such as "up" or "down", relative positions such as "front" and "back", and similar expressions used herein, even though the dispenser 10 may be occasionally or even fairly regularly used in other orientations. Beyond relating to this intended orientation, though, no additional meaning should be attributed to such expressions.

As indicated in FIG. 1 of the drawing, the protective sheet material dispenser 10 includes two separate components, namely an outer component or sheath 20 and an inner component or housing 30, the details of which will be discussed later. Before going any further, though, it is to be mentioned that, while at least the component 30 could be used by itself, it is currently preferred to use the components 20 and 30 together, that is in the assembled condition of the protective sheet material dispenser 10 shown in FIG. 1 of the drawing, because it achieves certain advantages that will be addressed as this discussion proceeds.

Figure 2:
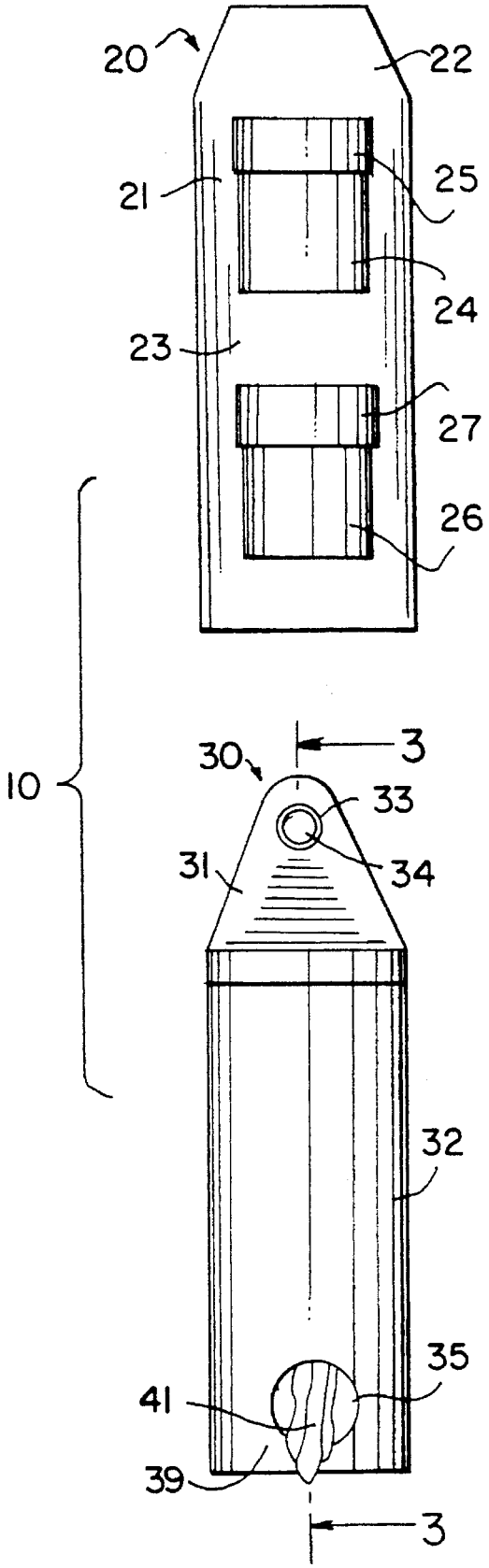
FIG. 2 is a view corresponding to that of FIG. 1 but with the dispenser being in its dissociated condition.

As shown in FIG. 2 in particular, the outer sheath 20, which is preferably made of a relatively pliant or flexible material, such as vinyl, leather, canvas or the like, includes a generally sleeve-shaped main body 21. The main body 21 includes an upper portion of a downwardly diverging configuration, and a remaining portion 23 of a substantially constant cross-section. It will be appreciated that, while the main body 21, owing to its flexibility, can be flattened, for instance for storage purposes, its utility comes into being when it is slid onto and over the inner component or container 30 as shown in FIG. 1. Under these circumstances, obviously, the entire sheath 20 has a tubular configuration, and so do its upper and remaining portions 22 and 23.

More particularly, the upper portion 22 has a substantially frusto-conical, and the remaining portion 23 has a substantially cylindrical, configuration in the condition assumed by the main body 21 when in use. Of course, the diverging portion 22 of the main body 21 prevents the sheath 20 from sliding downwardly off of the inner container 30, while the constant cross section of the remaining portion 23 permits the sheath 20 to be removed from the inner container 30, if so desired, by slipping it off upwardly with respect to the latter.

As also shown in FIG. 1 and especially in the upper part of FIG. 2 of the drawing, the main body 21 of the sheath 20 is provided on its outer periphery, and more particularly on the front region of such periphery, with at least one upwardly open pocket 24, the opening of which is covered by a flap 25. As a matter of fact, in the illustrated embodiment of the sheath 20 of the present invention, there is provided an additional pocket 26 situated in substantial vertical alignment with the first-mentioned pocket 24 underneath the latter. The upper opening of this additional pocket 26 is again covered, this time by a flap 27.

Reasons that led to the provision of such pockets 24 and 26 and flaps 25 and 27 will be presented later. It should be mentioned at this juncture, however, that there could be provided more than one or two of such pockets 24 and 26, if so desired. The number and distribution of such pockets 24, 26 and/or others, whether or not the openings of all of them are closeable, and even whether flaps such as 25 and 27 or other devices, such as zippers, are used for closing such openings, are determined in accordance with the intended uses to which such pockets are to be put, aesthetics and/or personal preferences.

Figure 3:
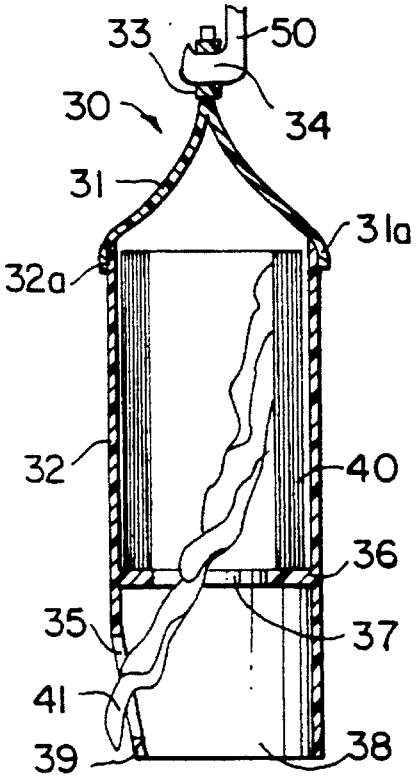
FIG. 3 is a cross-sectional view taken on line 3—3 of FIG. 2 through just an inner component of the dispenser of the invention.

As a comparison of the lower part of FIG. 2 with FIG. 3 will reveal, the inner component or container 30 includes, compatibly with the outer component or sheath 20, a downwardly diverging upper portion 31 and a remaining portion 32 with a substantially constant cross-section. The container 30 is of a material that is much more rigid than that of the sheath 20, but not necessarily completely rigid. Various materials, especially synthetic plastic materials such as polyethylene or polyvinyl chloride, lend themselves well for this purpose. Typically, the remainder portion 32 will be tubular and cylindrical in cross-section, and the upper portion 31 generally frusto-conical and hollow as well. As shown, however, the generally frusto-conical upper portion 31 is flattened at its upper region and carries an eyelet 33 that bounds a through orifice 34. Here again, the purpose of this arrangement will become clear later.

As illustrated especially in FIG. 3 of the drawing, the cylindrical remaining portion 32 of the container 30 is provided at its lower region with a through aperture 35 that is adapted for individual withdrawal of a leading one of a series of sheet materials 41 therethrough. The leading material 41, like those preceding it and those that will eventually follow, originally was preferably a part of an entire roll 40 of such materials 41 that is accommodated in the container 30 and rests on a partitioning wall 36. The materials 41 are wrapped about one another in succession in such a manner, which is per se known and hence need not and will not be discussed here, that peeling off of the leading material 41 and its eventual axial withdrawal from the inside of the roll 40 entrains the next following material 41, by friction or otherwise, for joint travel with the leading material 41 until the latter is dissociated from the former. The leading material could be cut from the roll 40, in which case, it is desirable if at least a part of the wall bounding the aperture 35 was sharpened or formed with a cutting edge, especially a serrated edge.

In the illustrated construction, the material 41 which has just been peeled off from the inside of the roll 40 first passes through an opening 37, which is formed in the partitioning wall 36 at a substantially centrally situated location, to enter a downwardly open lower region 38 of the container 30.

It would be possible, and it is contemplated by the present invention, for the user of the dispenser 10 to grab the leading material 41 and dissociate it from the successive one right then and there, through the open bottom of the lower region 38 of the container 30. However, in most instances, it will be more advantageous to thread the leading material 41 further through the aperture 35, as mentioned before, because then the leading end of the leading material 41 will be situated and held at a location ideally suited for grabbing the same between the forefinger and the thumb of the user in the orientation of the dispenser shown in the drawing, without having to go through any contortions.

It may also be seen in FIG. 3 that the lower region 38 of the container 30, besides forming a protective skirt for the materials 41, also forms a withdrawal channel 39 that extends from the aperture 35 all the way down to the lower end of the container 30. It will be appreciated that this channel 39 constitutes a passageway for receiving and guiding the leading material 41 after it emerges from the aperture 35 all the way down to the point of its departure from the dispenser 10.

Rather than providing the sheet materials 41 in a roll, they can be intertwined and nestled in a stack, also per se known. The stack, like the roll, would then be accommodated in the container 30.

Having so described the structure of the protective sheet material dispenser 10 and its components 20 and 30, their purpose, function, operation and cooperation will be addressed now in the context of using the dispenser 10 while playing the game of golf. However,-it should be understood that this is not the only use, and possibly not even the best use, for the dispenser 10, and that all such uses are to be considered to fall within the realm of the present invention even if not specifically mentioned here. One such additional use that comes readily to mind is in or on a vehicle, be it a golf cart, a family car, a pickup truck, a truck, a bus, a boat or other craft.

First of all, it ought to be reiterated that the container 30 could be used by itself, that is, without the sheath 20, as shown in FIG. 3 of the drawing. It is shown there that the container 30 may be suspended in its contemplated use in an upright orientation from a hook 50 passing through the orifice 34 of the eyelet 33. Traditionally, golf bags and similar receptacles are equipped with one or more of such hooks 50 for suspending various accessories or gadgets therefrom, so that the dispenser 10 is ideally suited for use as such a golfing accessory. However, if no such hooks 50 are provided or available, the orifice 34 of the eyelet 33 can instead be used for passing therethrough a string or a rope by means of which the container 30 is tied to the respective receptacle or another support, or even for the user to insert his or her finger thereinto and carry the dispenser 10 in that manner. The dispenser could be supported from any point thereon.

As mentioned before, the roll 40 of materials 41 is safely accommodated in the interior of the container 30, resting on the partitioning wall 36, and the respective material leaving the roll 40 and passing through the opening 37 first enters an environment that is still protected, namely the space circumferentially surrounded by the skirt-like lower region 38 of the container 30. When speaking of protection in this context, what is meant is not only protection from fraying or other damage, but also, and possibly even more importantly, from the elements, that is from wind and especially from rain and other precipitation. This kind of protection is often desired by golfers or other sport enthusiasts in order to always have dry sheet materials 41 readily available, for instance to wipe their faces or hands with, even if playing or finishing a round of golf or other game while it is drizzling or even raining, as well as to clean the golf club faces from dirt or mud.

It will be appreciated that the skirt-like lower region 38 by itself provides this kind of protection, but only if the leading material 41 is not threaded through the aperture 35. Otherwise, that portion of the leading material 41 that sticks out of the aperture 35 and/or is received in the channel 39 is exposed to the elements and hence can easily get wet. As mentioned before, though, it is quite cumbersome to reach and get hold of the leading material 41 through the open end of the lower region 38, so that the easy access to the leading end of the leading material 41 which ensues from passing that end through the aperture 35 is actually preferred.

This is where the sheath 20 comes into play. More particularly, when the sheath 20 is slipped over the container 30 in the manner depicted in FIG. 1 of the drawing, the thus projecting end of the leading material 41 is confined in an intervening space present between the outer surface of the container 30 and the inner surface of the sheath 20, with the channel 39, if provided, constituting a part of this intervening space. Under these circumstances, the projecting end of the leading material 41 is protected from the elements as well as a result of being covered by the sheath 20, so long as it remains in the aforementioned intervening space or gap. On the other hand, it is very easy for the prospective user of the leading material 41 to reach only a short distance into the gap from below, engage the leading material end, and pull on it to thereby draw the entire leading material 41 through the aperture 35 and channel 39 out of and away from the assembled dispenser 10.

Of course, it is necessary, from time to time, to introduce a new material roll or stack into the interior of the container 30 as a substitute for a previously exhausted one. To this end, the upper portion 31 and the remaining portion 32 of the container 30 are shown to be constituted by two separate parts having respective connecting regions 31*a* and 32*a* that overlap one another. The connecting regions 31*a* and 32*a* are connected with one another in any well known manner so as to stay together under normal use conditions of the container 10 but to be easily separated when it is necessary to gain access to the interior of the container 30 for the above or other purpose. So, for instance, the regions 31*a* and 32*a* can be provided with mating external and internal threads, with bayonet-type connecting projections or recesses, or the like. Another approach would be to provide an opening in a side of the container. The new roll would be introduced through this side opening. The opening could be closed by a zipper or by analogous fasteners, e.g., Velcro™.

The pockets 24 and 26 can be used for the storage of a variety of items that can come in handy during the golf game, such as spare balls, tees or the like. In the alternative, they may be used for temporarily receiving already used materials, until the arrival to a location at which such spent materials can be discarded or otherwise disposed of. The flaps 25 and 27 protect the interiors of the pockets 24 and 26, respectively, from the penetration of rain water or other moisture and/or dust thereinto, thus protecting the used materials or other items contained therein from becoming either wet or soiled, or both.

It will be understood that each of the elements described above, or two or more together, may also find a useful application in other types of constructions differing from the type described above.

While the present invention has been described and illustrated herein as embodied in a specific construction of a protective sheet material dispenser for use on golf courses, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A protective dispenser for dispensing serially arranged sheet materials, comprising:

a) a container bounding an internal chamber for receiving the sheet materials, said chamber having an open end; and b) supporting means in said internal chamber for supporting the sheet materials, including a partitioning wall spanning said internal chamber of said container and having a substantially centrally arranged opening therein for the successive passage of the sheet materials therethrough, said partitioning wall being disposed at a predetermined distance from said open end of said chamber so that a skirt region of said container that surrounds said open end provides an environment that is sheltered from the elements for the sheet materials to emerge into after passing through said opening.

2. The dispenser as defined in claim 1, wherein said skirt region has at least one aperture therein for the passage of the respective sheet material therethrough from said sheltered environment to the outside of said container.

3. The dispenser as defined in claim 2, wherein said partitioning wall lies in a plane, and wherein said aperture lies in another plane inclined relative to the plane of said partitioning wall.

4. The dispenser as defined in claim 2, wherein said skirt region includes means for forming a channel at the exterior of said container leading from said aperture all the way to a free end of said skirt region.

5. The dispenser as defined in claim 1, wherein the container has a tubular configuration.

6. The dispenser as defined in claim 1; and further comprising a sheath surrounding at least a part of said container in an assembled condition thereof.

7. The dispenser as defined in claim 6, wherein said container has an end portion remote from said skirt region; and wherein said sheath is generally sleeve-shaped, having two open end portions one for the passage of said remote end portion of said container therethrough.

8. The dispenser as defined in claim 7, wherein said remote end portion of said container and said one end portion of said sheath have compatible configurations diverging toward said skirt region and the other of said end portions, respectively.

9. The dispenser as defined in claim 6, and further comprising at least one closeable pocket on the exterior of said sheath.

10. The dispenser as defined in claim 1, wherein said container has an end portion remote from said skirt region; and further comprising means on said remote end portion for suspending said container from a support.

11. The dispenser as defined in claim 10, wherein said suspending means includes an eyelet bounding an orifice for the passage of a portion of the support therethrough.

12. The dispenser as defined in claim 10, wherein said end portion of said container is removably mounted thereon.

13. The dispenser as defined in claim 1, wherein the sheet materials are arranged in a roll extending along an axis, and wherein the partitioning wall lies in a plane perpendicular to said axis.

* * * * *